United States Patent [19]

Ceyer

[11] 4,020,594

[45] May 3, 1977

[54] LEVERLESS DOOR MECHANISM

[75] Inventor: Alfons W. Ceyer, Berwyn, Ill.

[73] Assignee: Evans Products Company, Portland, Oreg.

[22] Filed: Aug. 6, 1975

[21] Appl. No.: 662,284

[52] U.S. Cl. ..... 49/220; 49/395

[51] Int. Cl.[2] ..... E05D 15/10

[58] Field of Search ..... 49/209, 210, 216–220, 49/395

[56] References Cited

UNITED STATES PATENTS

| | | | |
|---|---|---|---|
| 3,488,074 | 1/1970 | Herr | 49/220 X |
| 3,613,312 | 10/1971 | Wolak et al. | 49/220 |
| 3,653,153 | 4/1972 | Nagy | 49/220 |

*Primary Examiner*—Kenneth Downey
*Attorney, Agent, or Firm*—F. Travers Burgess

[57] ABSTRACT

A railway house car plug door includes mechanism for moving the door transversely of the car side wall out of and into closed position and for ensuring that the door locking bars are retracted during such transverse movements, and are in locking position when the door is fully closed and comprises a vertically elongated plate mounted for rack and pinion actuated vertically slidable movement in guides on the door. At its upper end the plate is notched at both sides and provided with protruding ears engageable with rolls on bellcranks to actuate the top locking bars, these bellcranks being connected by vertical links to bellcranks controlling the bottom locking bars. Near its upper end the plate mounts a generally upright, partly inclined slotted cam, the follower of which is mounted on a transversely movable bar pivotally connected at its ends to bars connected to arms on the door operating shafts whereby to rotate the latter between door-closed and door-open positions, the portion of the cam which corresponds to the projected position of the locking bars being vertical to prevent operation of the operating shafts when the locking bars are projected.

23 Claims, 16 Drawing Figures

LEVERLESS DOOR MECHANISM

BACKGROUND OF THE INVENTION

1. Field of the Invention

The invention relates to doors for railway house cars and consists particularly in a leverless-type mechanism for operating such doors.

2. The Prior Art

The prior art includes manually rotatable plates formed with helical slots and external cam surfaces the followers of which are connected to door-operating shafts and locking bars; manually operated linkages including bellcranks operatively connected to the mounting shafts and locking bars; and cable actuators including pulleys operatively connected to the mounting shafts and locking bars.

SUMMARY OF THE INVENTION

The invention provides a simple yet effective leverless operator for plug doors which utilizes a minimum of moving parts and is relatively inexpensive to construct and, because of its simplicity, is durable and cheap to maintain.

Among the objects of the present invention are simplicity of construction, the provision of effective means to prevent accidental movement of the door from fully-closed position, assurance of proper sequence of door movements transversely of the wall and of locking and unlocking of the door with respect to the transverse movements of the door.

DETAILED DESCRIPTION OF THE INVENTION

Figure 2:
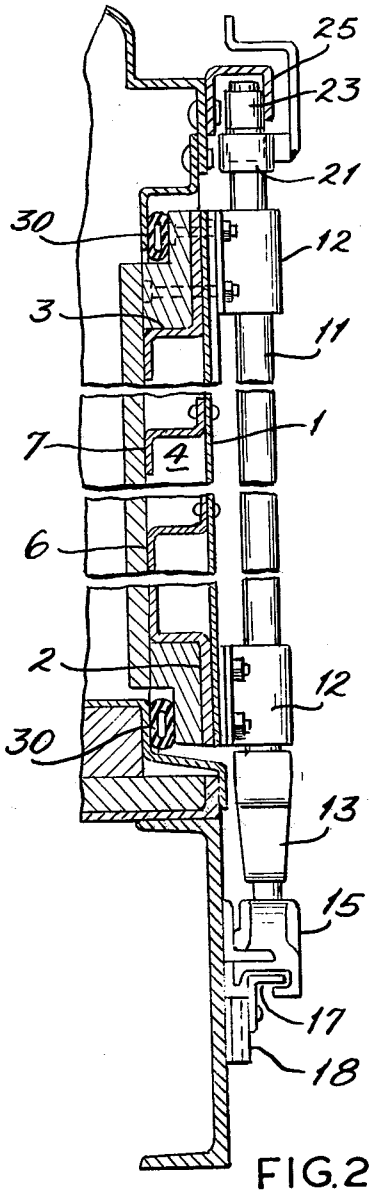
FIG. 2 is a transverse vertical sectional view taken along line 2—2 of FIG. 1.

The door comprises metal sheets 1 secured to a frame formed by members 2, 3 and 4 at its bottom, top and side edges and intermediate horizontal members 6 and 7. Upright operating shafts 10 and 11 are journaled at 12 on the door outwardly from sheets 1 and have crank arms 13 on their lower ends which mount the shafts and door upon wheeled carriages 15 which travel on horizontal track 17 supported by brackets 18 on the car side sill 19. A stop 20 on the car wall engages front carriage 15 to limit forward movement of the door. Each crank arm 13 pivots at one end on carriage 15 so that when its shaft is rotated it moves the door transversely of the car wall 16. At their upper ends shafts 10 and 11 mount similarly positioned cranks 21 the extremities of which rotatably mount rollers 23 which engage the inner surface of door retainer rail 25 mounted on car side wall 16 above the door opening. Operating cranks 27 are fixed on shafts 10 and 11 above crank arms 13, and are shorter than the latter and are connected to individual horizontal operating bars 29 extending toward the middle of the door. Along its sides, top and bottom the door mounts an inwardly facing compressible gasket 30 which sealingly engages flanges on the threshold, header and door posts which define the door opening in car side wall 16.

The door-operating mechanism embodying the invention comprises an upright base plate 31 secured to the exterior of the door sheets 1 and rigidly mounting a pair of outwardly projecting vertical guide bars 33 spaced apart lengthwise of the door and vertically slidably mounting an operating plate 35 having outwardly turned flanges 37 in slidable engagement with guide bars 33 so as to ensure vertical movement of plate 35. On the upper portion of plate 35 an operating cam 39 (preferably formed of a casting) is mounted for controlling the movement of operating bars 29. For operatively connecting cam 39 to operating bars 29, a cam follower in the form of a roller 41 is mounted in the generally vertically elongated slot 43 of cam 39 and is journaled on a bolt 42 secured to transversely extending bar 45 positioned outwardly of base plate 31 and formed at its opposite ends with clevises 47 to which are pinned eye members 49 adjustably connected by nuts 51 to the ends of operating bars 29.

The mechanism is enclosed by a cover plate 44 spaced outwardly from base plate 31 by inwardly bent flanges 46, which have outwardly rebent terminals 48 for securement to the vertical margin of base plate 31. Cover plate 44 is formed with a horizontal slot 50 aligned with operating bars 49, to permit the protrusion therethrough of cam follower journal bolt 42 and to guide bar 45, which is outside of cover plate 44, horizontally, cover plate 44 externally mounts a pair of guide brackets 52 through which bar 45 slides.

Slot 43 of cam 39 is generally inclined slightly from the vertical in a manner which will be described in greater detail hereinafter, so that vertical movement of plate 35 will cause sufficient movement of bar 45 and operating bars 29 to rotate mounting shafts 10 and 11 from the door-closed position in which mounting cranks 13 are generally parallel to the car side to a door-open position in which the mounting cranks 13 are substantially normal to the car side.

A pair of upper horizontal locking bars 53 are slidably mounted on the door for projection beyond the edges of the door to engage keepers 55 on the car wall adjacent both sides of the door. The inner end of each of the locking bars 53 is pivoted to a bellcrank 57 fulcrumed at 59 on door mechanism base plate 31. At its inner end each of the bellcranks 57 mounts a roller 61 which extends into a notch 63 in the upper end portion of plate 35 so that upward movement of plate 35 from its door-closed position will cause bellcranks 57 to rotate about their fulcrum 59 on the door thereby pulling locking bars 53 toward the center of the door and out of keepers 55. Bottom locking bars 67 are similarly connected at their inner ends to bellcranks 69 which are fulcrumed at 71 on the door, and vertical links 73 are pivotally connected at their upper ends at 75 to upper bellcranks 57 and at their lower ends at 77 to lower bellcranks 69 so as to cause the lower bellcranks and locking bars 67 to move in unison with the upper bellcranks and upper locking bars 53 to the retracted position.

To ensure that locking bars 53 and 67 are fully retracted from keepers 55 prior to opening movements of operating shafts 10 and 11 and are not projected into the keepers until operating shafts 10 and 11 have moved the door into fully-closed position, the upper end portion 79 of slot 43 in cam 39 is a vertical dwell.

In order to provide for relatively slow transverse movement of the door during decompression and compression of door gasket 30, the intermediate portion 81 of slot 43 is slightly inclined from the vertical, and to provide final fast-action travel of the cam and correspondingly fast-opening movement of shafts 10 and 11, as well as initial fast-action and correspondingly fast initial closing movement of shafts 10 and 11, the lower portion 83 of cam slot 39 is inclined a substantially greater amount from the vertical than cam intermediate portion 81.

Thus it will be evident that as plate 35 is moved upwardly relative to base plate 31, the initial upward movement causes the engagement of rollers 61 with the bottom shoulder 62 on notches 63 of plate 35 thereby pivoting upper bellcranks 57 about their fulcrums 59 and retracting upper locking bars 53 from keepers 55, similar retracting movement of lower locking bars 67 being caused by links 73 and bottom bellcranks 69. During retraction of locking bars 53 and 67, cam roller 41 has moved vertically in upper portion 79 of cam slot 43 so that connecting plate 45 and operating bars 29 have not moved and no rotation of operating shafts 10 and 11 has been produced, thus delaying any outward movement of the door during retraction of the locking bars. As plate 35 continues its upward movement, cam roller 41 enters the slightly inclined intermediate portion 81 of slot 43 and moves at slow speed toward the left, causing corresponding slow opening movement of shafts 10 and 11 until the door gasket is fully decompressed and follower roller 41 enters the lower fast-action travel portion 83 of cam slot 43, whereupon it moves rapidly to the left by virtue of the greater inclination of slot portion 83, thus producing a rapid final pivoting of shafts 10 and 11 and their mounting crank arms 13 to the door fully-opened position wherein the door is entirely positioned outwardly of the side wall and is ready to be translated lengthwise of the wall out of registry with the door opening therein.

Closing of the door follows a reversal of the procedure described above. The door is first translated lengthwise of the wall into general registry with the door opening and plate 35 is lowered in housing 31. As plate 35 is lowered, cam roller 41 initially moves rapidly to the right in slot 43 by virtue of the relatively greater inclination of the lower portion 83 of slot 43 until the door approaches engagement with the gasket and cam roller 41 enters gradually inclined intermediate portion 81 of slot 43 wherein it moves to the right at a substantially reduced rate causing a corresponding reduction in the rate of rotation of operating shafts 10 and 11 and a corresponding slowing down in the rate of closing of the door until the door is fully closed, at which point roller 41 enters the upper vertical portion 79 of slot 43 and the upper shoulder 62A on each of the notches 63 in plate 35 bears down against rollers 61 on bellcranks 57 causing downward rotation of the bellcranks about their fulcrums 59 and outward projection of locking bars 53 into keepers 55. Simultaneously, ears 85 secured to plate 35 engage rollers 78 on bottom bellcranks 69, ensuring that the latter will pivot downwardly and move bottom locking bars 67 outwardly until they project into bottom keepers 55.

Figure 1:
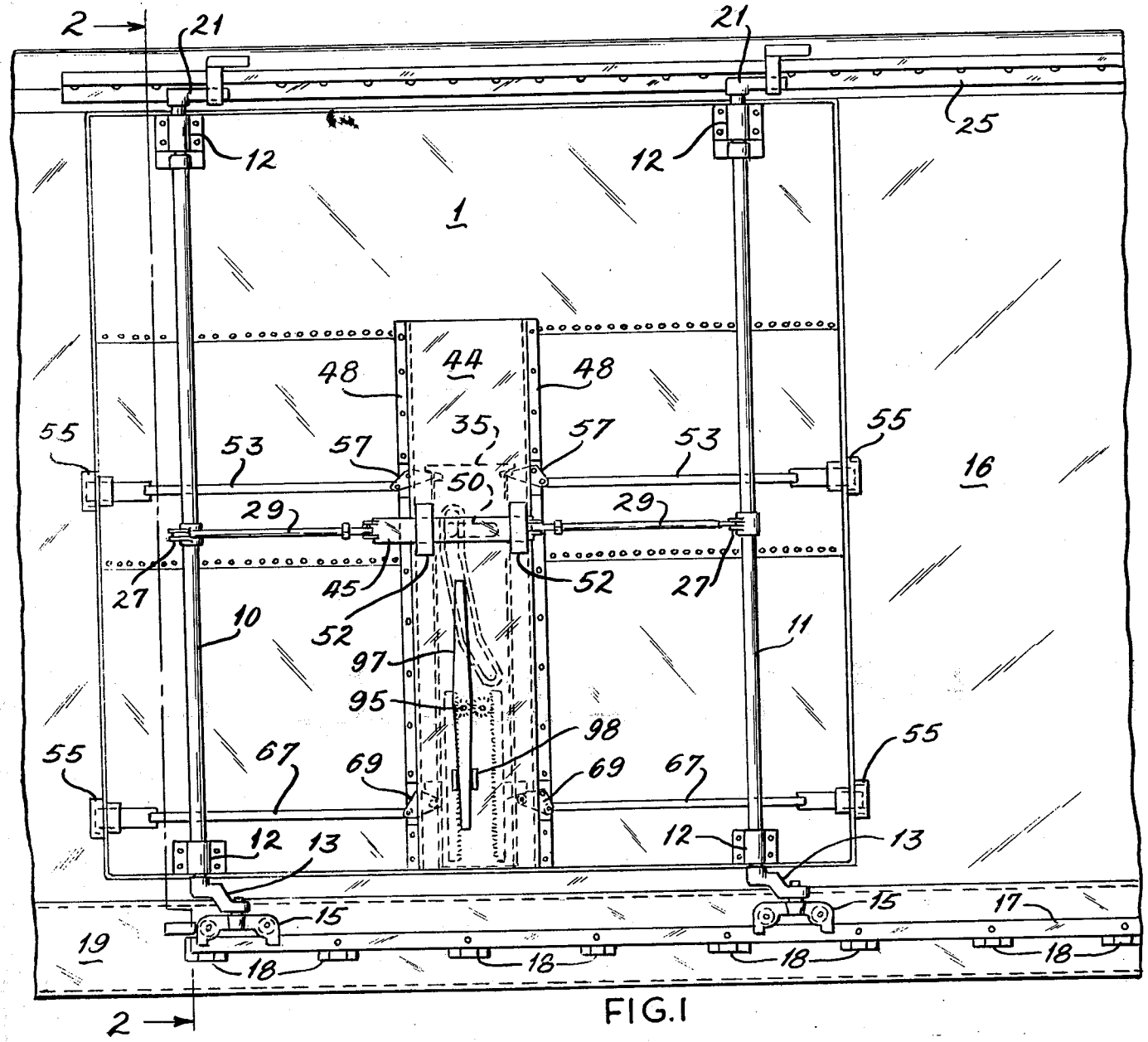
FIG. 1 is a side elevation of a plug door and adjacent portions of a railway house car side wall showing door operating mechanism embodying the invention, with the door in closed and locked position.
Figure 3:
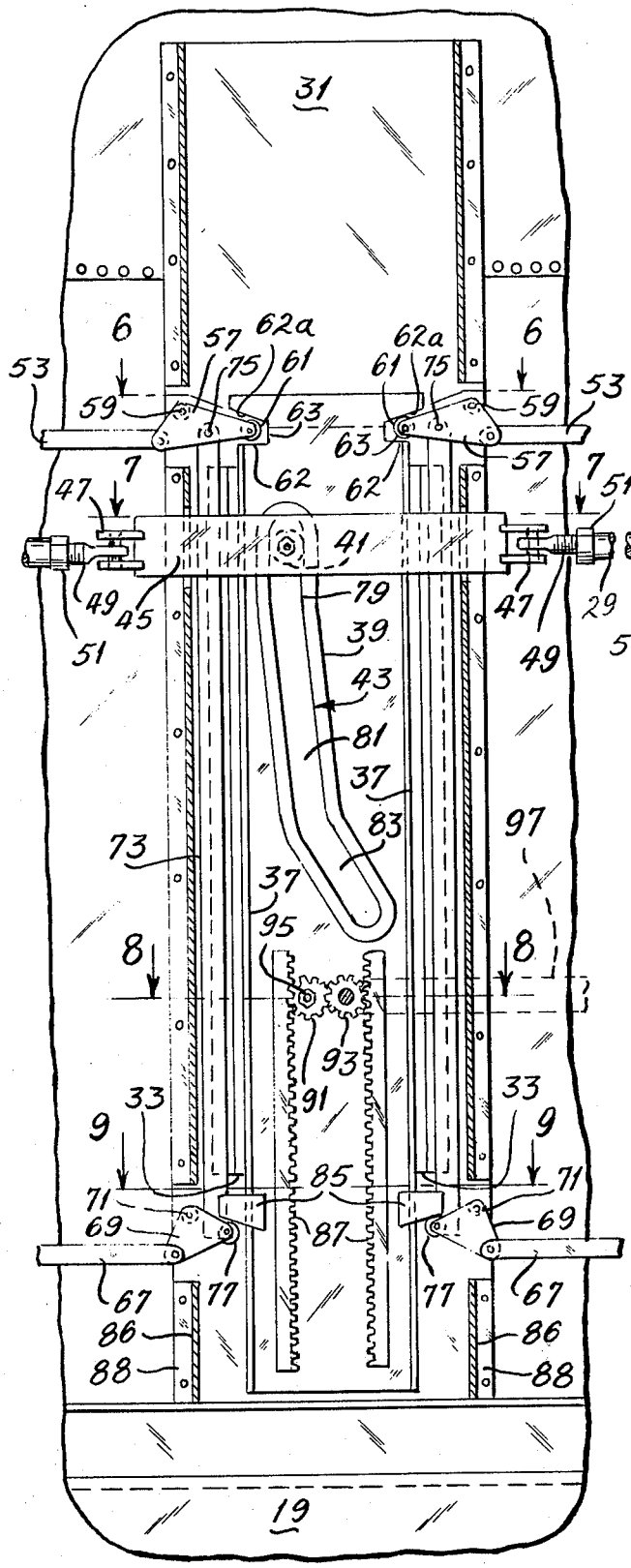
FIG. 3 is an enlarged front elevational view of the door operating mechanism in door-closed and locked position.

For providing the upward opening and downward closing movements of plate 35, the lower portion thereof mounts a pair of racks 87, spaced apart transversely of plate 35, which is apertured, between them and having their teeth 89 facing each other. Plate 35 is apertured at 88 to accommodate a pair of pinions 91 and 93 which are journaled in side by side relation in base plate 31 and cover plate 44 and mesh with each other and respectively with teeth 89 of racks 87. The hub 95 of pinion 91 extends outwardly from base plate 31 and mounts an operating handle 97 for manually rotating drive pinion 91, clockwise rotation of the handle and drive pinion 91 producing counterclockwise rotation of idler pinion 93 and upward movement of racks 87 and plate 35, counterclockwise rotation of handle 97 conversely producing downward movement of racks 87 and plate 35. When the door is closed and locked, handle 97 is retained in the vertical closed door position shown in FIG. 1 by a stop and latch device 98 to which the usual shipper's seal (not shown) may be applied.

Figure 4:
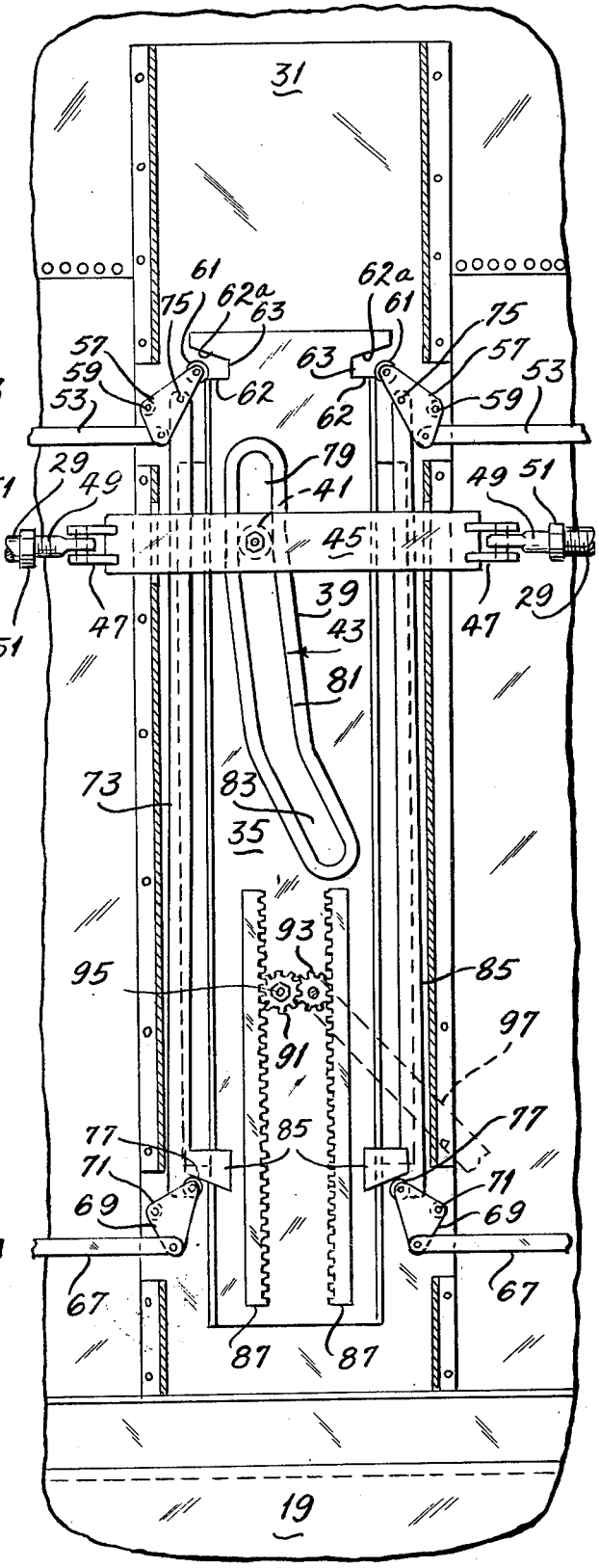
FIG. 4 is a front elevational view of the mechanism showing the first sequence of opening operation in which the locking bars are fully retracted without any movement of the operating shafts.
Figure 5:
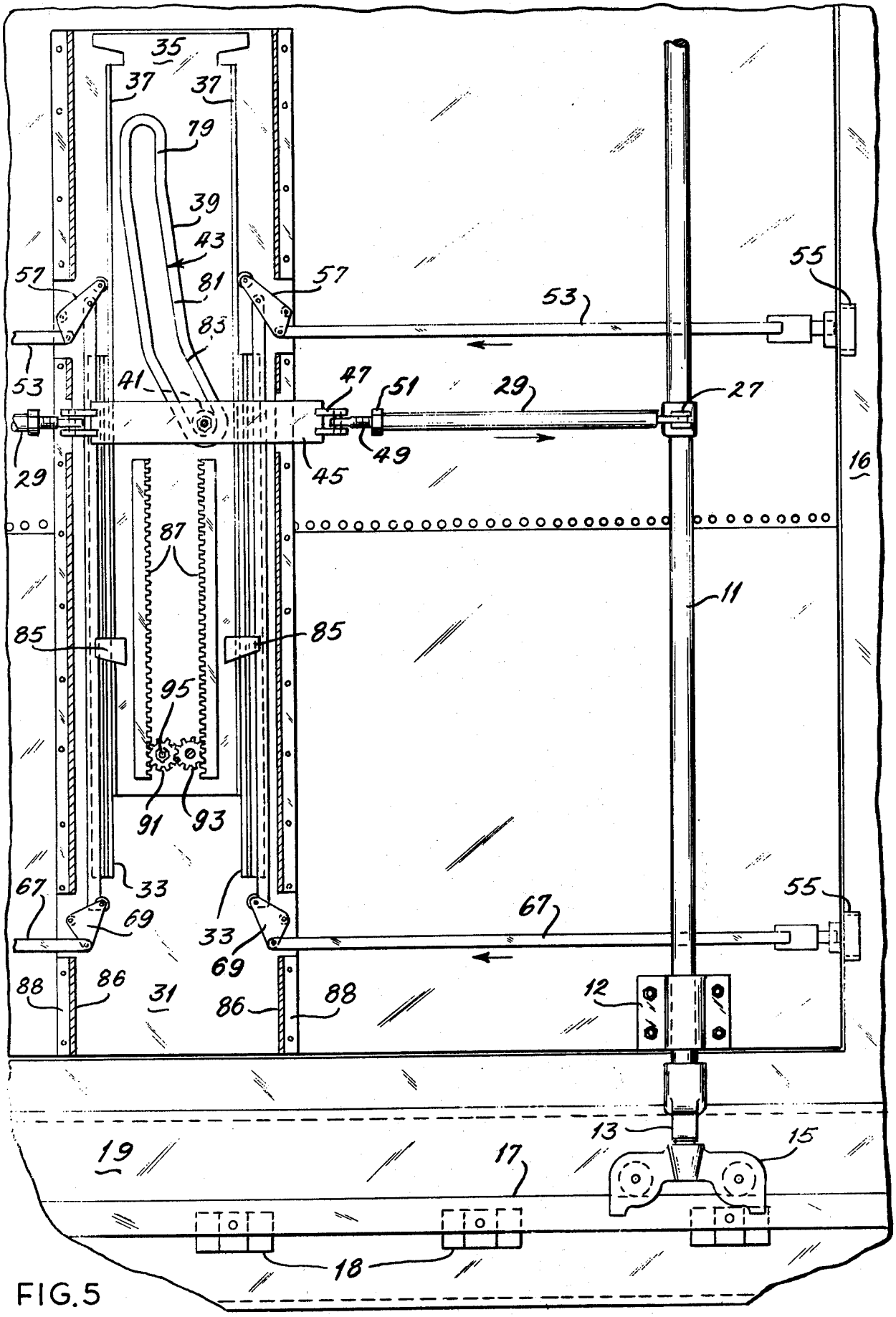
FIG. 5 is a front elevational view corresponding to FIG. 4 but showing the locking bars fully retracted and the operating shafts rotated to fully-open position.
Figure 9:
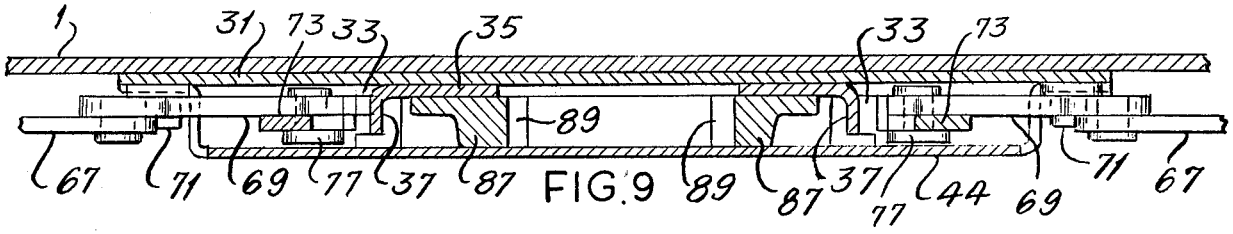
FIGS. 6–9 are, respectively, horizontal sectional views taken along lines 6—6, 7—7, 8—8 and 9—9 of FIG. 3.
Figure 8:
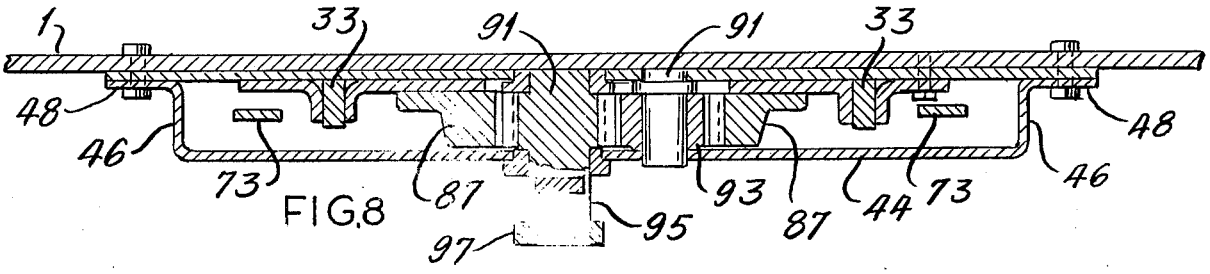
Figure 7:
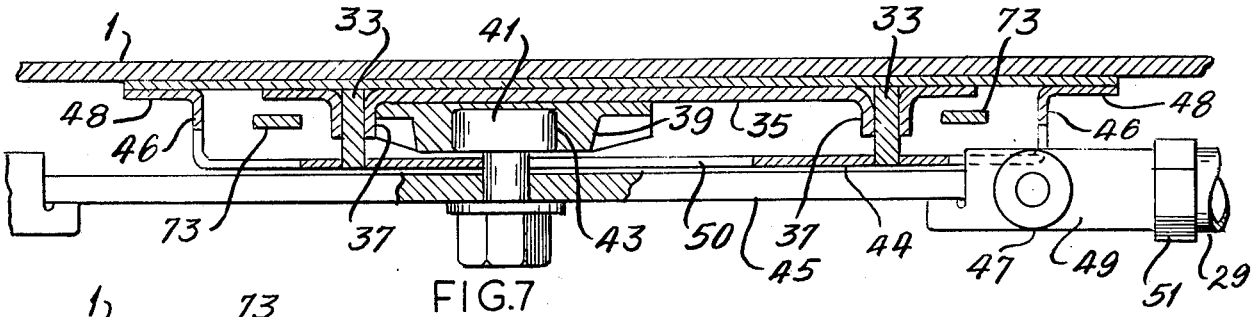
Figure 6:
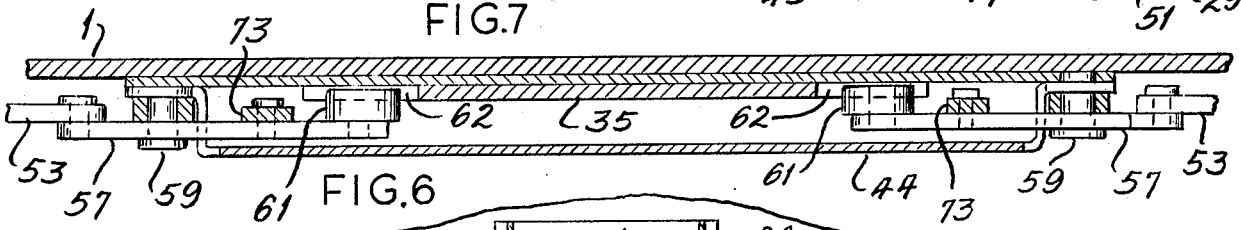

Operation of a door equipped with this mechanism is as follows: With the door closed and sealed, in the position shown in FIGS. 1 and 2, the seal is broken, latch 98 released and handle 97 rotated clockwise, causing pinions 91 and 93 to rotate respectively clockwise and counterclockwise and thereby cause upward movement of racks 87 and operating plate 35. As this upward movement occurs, bottom shoulders 62 on upper notches 63 engage rollers 61 on bellcranks 57, causing rollers 61 to move upwardly and thereby rotate left-hand bellcrank 57 counterclockwise and right-hand bellcrank clockwise until they reach the position shown in FIGS. 4 and 5 wherein top locking bars 53 are fully retracted from keepers 55, and links 73 have caused similar movements of bottom bellcranks 69 and retraction of bottom locking bars 67 from keepers 55.

During this retraction of the locking bars, no transverse movement of the door occurred because of the vertical disposition of the upper end 79 of cam slot 43, whereby operating shafts 10 and 11 were held stationary.

During continued upward movement of operating plate 35, rollers 61 of upper bellcranks 57 ride on flanges 37 of plate 35 maintaining the locking bars in retracted position, and cam roller 41 enters the slightly inclined intermediate portion 81 of cam slot 43 to cause a gradual rotation of operating shafts 10 and 11 and correspondingly slow initial outward movement of the door, during which the door gaskets are fully decompressed. As upward movement of plate 35 continues, cam roller 41 enters the lower more inclined portion 83 of cam slot 43, causing rapid movement to the right of roller 43, bar 45 and operating bars 29 and correspondingly rapid final rotation of operating shafts 10 and 11 to the position shown in FIG. 5 wherein cranks 13 (and 21) are substantially normal to the car side and the door is fully positioned outside the car wall. The door may then be rolled rearwardly along track 17 to fully-open position out of registry with the door opening.

Closure of the door is accomplished by rolling the door forward along track 17 until front roller carriage 15 engages stop 20 on the car wall, then rotating handle 97 counterclockwise. This causes plate 35 to move downwardly, causing initial rapid rotation of shafts 10 and 11 as cam roller 41 moves through the lower portion 83 of cam slot 43 and correspondingly rapid initial transverse inward movement of the door. As downward movement of plate 35 continues and cam roller 41 enters the intermediate portion 81 of cam slot 43, the cam roller moves more slowly horizontally, causing a reduction in the rotational speed of shafts 10 and 11 and a corresponding reduction in the rate of transverse inward movement of the door during the compression of the door gaskets. As soon as gaskets 30 are fully compressed and the door seated in the opening, continued downward movement of plate 35 causes roller 41 to enter the upper vertical portion 79 of cam slot 43, thereby terminating horizontal movement of the roller and resultant transverse movement of the door, and as downward movement of plate 35 continues, upper shoulders **62*a* on plate 35 engage upper bellcrank rollers 61 and ears 85 on plate 35 engage lower bellcrank rollers 77, thereby causing projection, respectively, of top and bottom locking bars 53 and 67 into their respective keepers on the car side. On completion of the movement, handle 97 is again in the vertical position shown in FIG. 1**.

Figure 10:
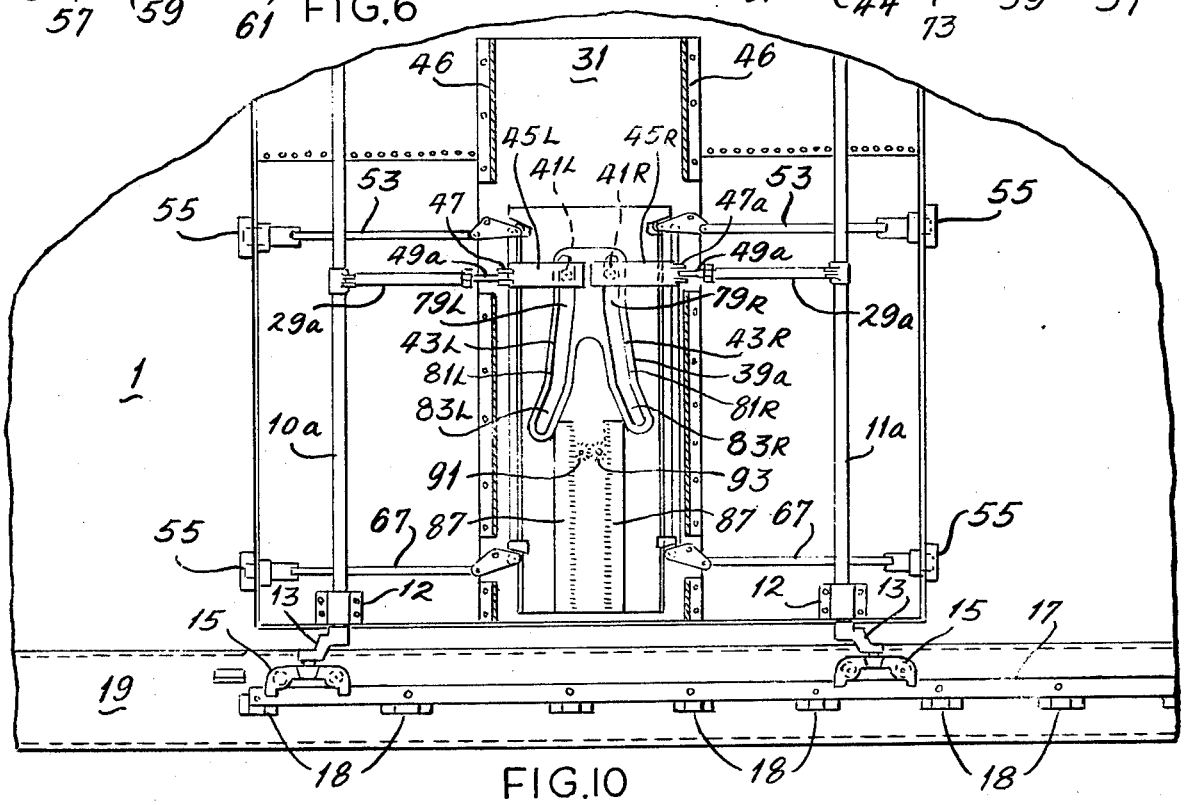
FIG. 10 is a front elevational view corresponding to FIG. 1 but showing a plug door equipped with a modified operating mechanism embodying the invention.
Figure 11:
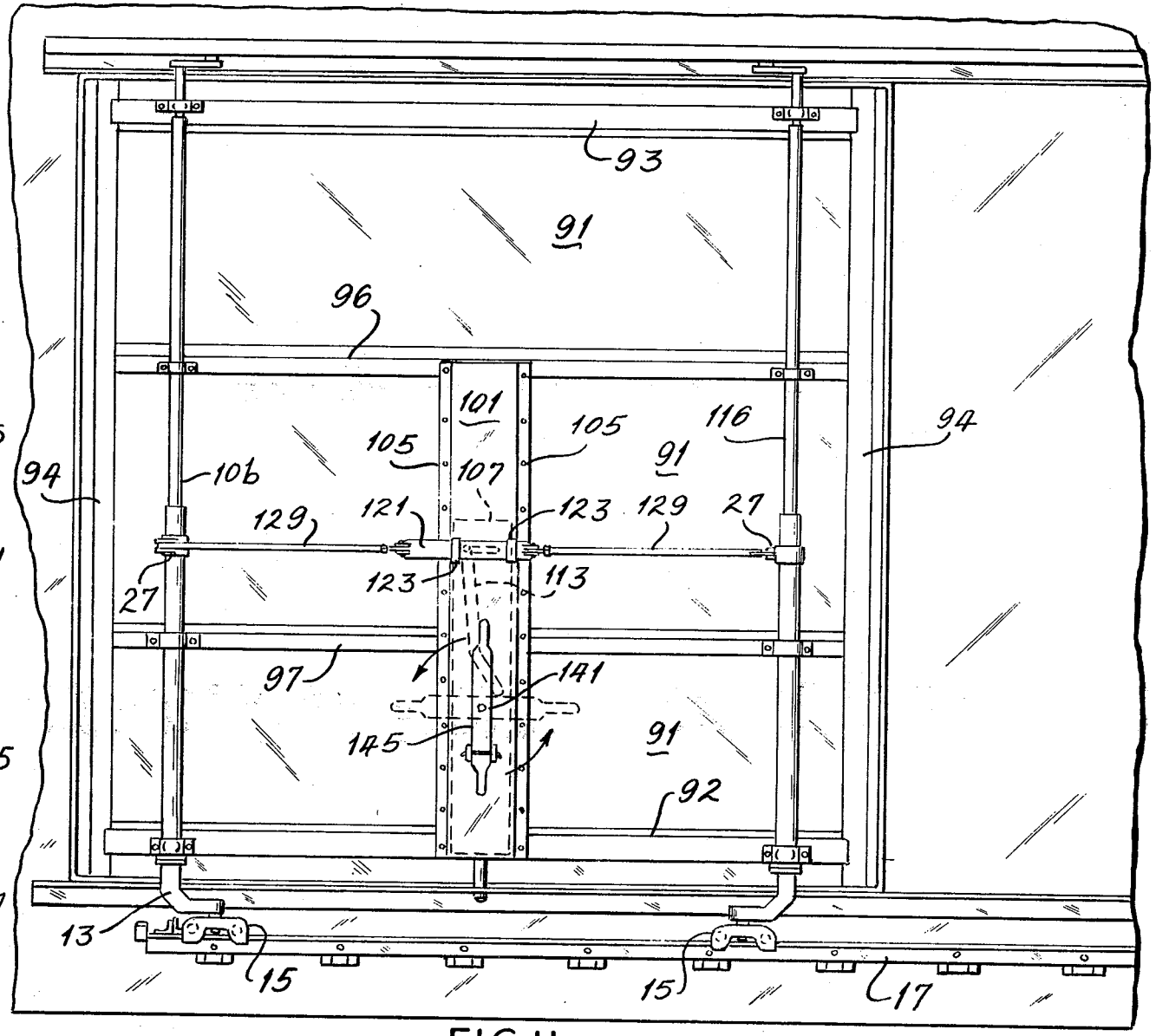
FIG. 11 is a front elevational view of a plug door equipped with a third form of operating mechanism embodying the invention.
Figure 16:
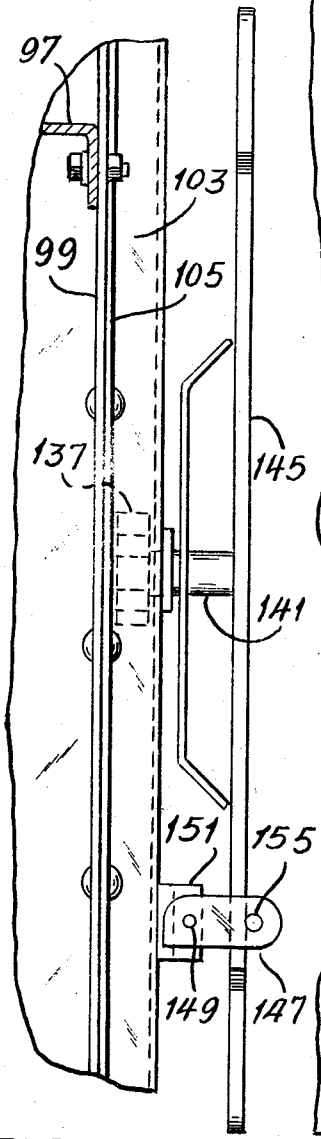
FIG. 16 is a fragmentary side view of the mechanism shown in FIG. 11 taken from line 16—16 of FIG. 12.
Figure 12:
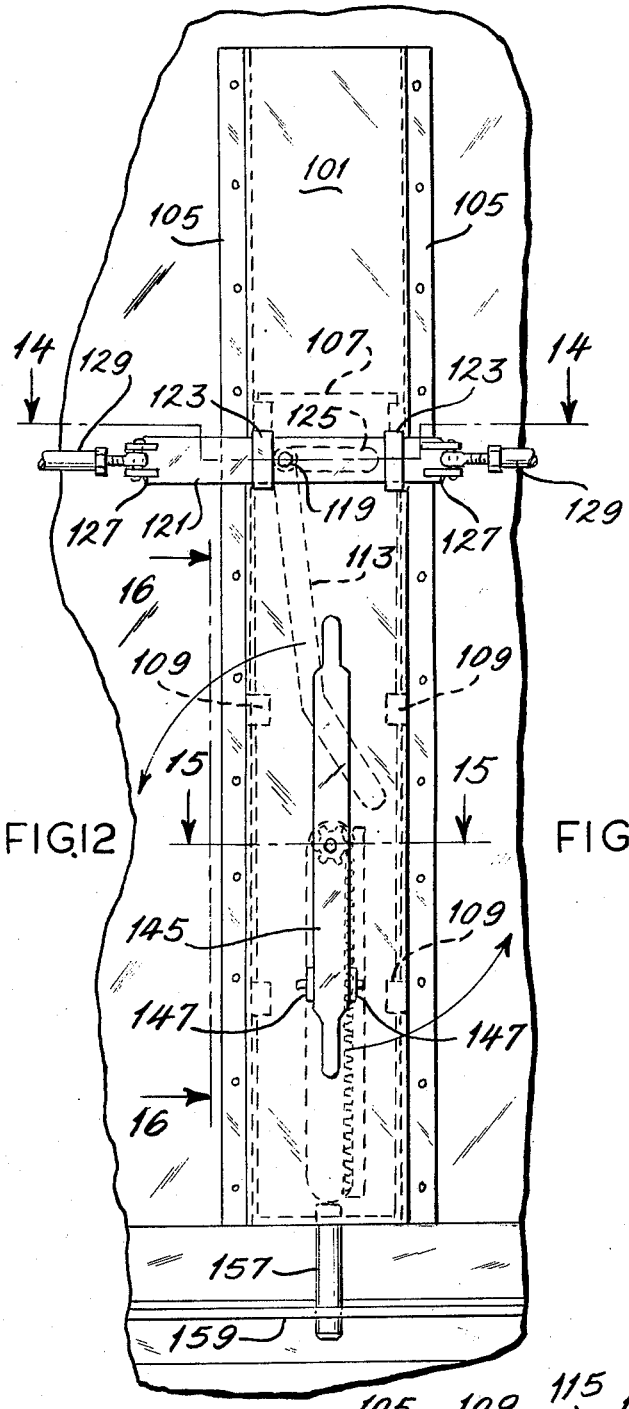
FIG. 12 is an enlarged frontal view of the mechanism illustrated in FIG. 11.
Figure 13:
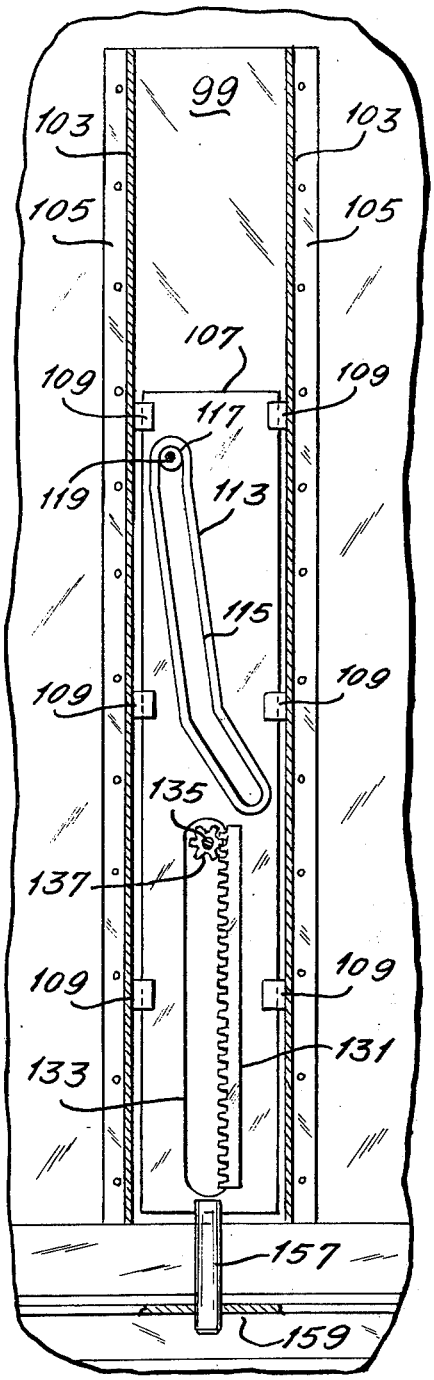
FIG. 13 is a vertical sectional view of the mechanism of FIGS. 11 and 12 taken along line 13—13 of FIGS. 14 and 15.
Figure 14:
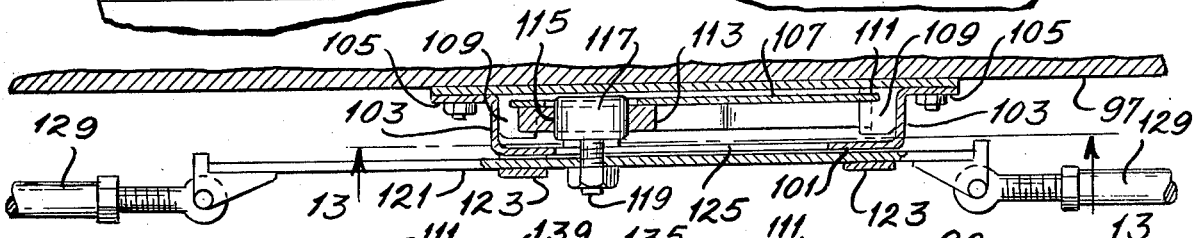
FIGS. 14 and 15 are horizontal sectional views taken along lines 14—14 and 15—15 respectively of FIG. 12.
Figure 15:
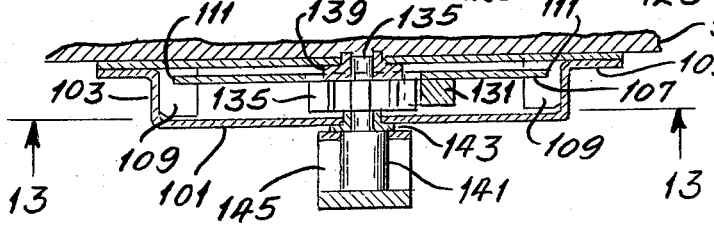

The embodiment shown in FIG. 10 is substantially identical in construction and operation to the first embodiment except that it is arranged to provide simultaneous rotation of the operating shafts in opposite directions instead of in the same direction because of the operating shaft cranks 13 being arranged in opposite directions. To achieve this objective, a double cam **39*a* is formed with separate slots 43L and 43R, slot 43L being slightly inclined to the left and slot 43R being similarly inclined to the right. As in the first embodiment, the upper portions 79L and 79R of slots 43L and 43R are vertical so as to prevent any movement of operating shafts 10*a* and 11*a* during retraction or projection of locking bars 53 and 67, the intermediate portions 81L and 81R of slots 43L and 43R being gradually inclined from the vertical so as to provide gradual decompression of the gasket during opening movement and gradual compression of the gasket during closing movements of the door; and the lower portions 83L and 83R of slots 43L and 43R are substantially more inclined with respect to the vertical to provide final fast-action travel of cam follower rollers 41L and 41R during opening movement of the door and initial fast action of the cam follower rollers 41L and 41R during closing movement of the door. To transmit movements of the separate cam follower rollers 41L and 41R to operating shafts 10*a* and 11*a*, separate connecting plates 45L and 45R are connected respectively to rollers 41L and 41R and each is formed with a clevis 47*a* for pivotal connection to adjustment eye 41*a* on the adjacent ends of operating bars 29*a* which, in turn, are connected to operating arms 21*a* on mounting shafts 10*a* and 11*a***.

Operation of the embodiment of FIG. 10 is generally similar to that of FIGS. 1–9.

In the embodiment illustrated in FIGS. 11–16 the door comprises metal sheets 91 with external framing members 92, 93 and 94 at its bottom, top and side edges and intermediate horizontal framing members 96 and 97.

Operating shafts **10*b* and 11*b* are journaled on the door as in the previously described embodiments and may have their crank arms 13** positioned in opposite directions, as shown, or in the same direction as in the first embodiment.

The mechanism for operating the operating shafts **10*b* and 11*b* comprises a vertically elongated base plate 99 to which is secured a correspondingly vertically elongated shallow cover plate having a web 101 with inwardly directed marginal flanges 103 with vertically rebent terminals 105, the cover plate being secured to the base plate by rivets through flange terminals 105 and the margins of base plate 99**.

A vertically movable operating member comprising a vertically elongated plate 107 is positioned in the space defined by base plate 99 and cover plate web 101 and flanges 103 and a plurality of blocks 109 of nylon or similar material, slotted as at 111 for mounting on the margins of plate 107 so as to completely surround the margins and shaped to slidably engage base plate 99, the adjacent cover plate flange 103 and cover plate web 101.

A cam 113, having a slot 115 of generally similar configuration to slot 43 of cam 39 in the first embodiment, is secured to the upper portion of plate 107.

A follower 117 in the form of a roller is journaled on a member 119 secured to a transversely extending bar 121 which is slidably mounted in brackets 123 on the outer surface of cover plate web 101, web 101 being transversely slotted at 125 to accommodate transverse movements of follower journal member 119 caused by vertical movement of operating plate 107 and cam 113. At its opposite ends follower bar 121 mounts clevises 127 which are connected to the inner ends of operating bars 129, the opposite ends of which are pivotally connected to cranks 27 on shafts **10*b* and 11*b* respectively. If oppositely directed crank arms 13 are provided and it is therefore necessary to rotate their respective shafts 10*b* and 11*b* in opposite directions simultaneously to move the door laterally of the car, one of the operating cranks 27** may be positioned to extend inwardly of its shaft and the other outwardly of its shaft as the shafts are moved from door-closed to door-open position, thus obviating the need for separate cam slots as provided in the second embodiment of the invention, this arrangement being usable only on single sheathed doors with outside framing.

For effecting vertical opening and closing movements of operating plate 107, a single upright rack 131 is mounted on the front face of the lower portion of the plate slightly offset from the vertical axis of the plate and adjacent rack 131, plate 107 is vertically slotted at 133 to permit the extension therethrough of the shaft 135 of pinion 137 into a bearing member 139 mounted on base plate 99. The outer end 141 of pinion shaft 135 extends through a bearing 143 in cover plate web 101 and mounts an operating handle 145 which can be rotated to cause pinion 137 engaged with rack 131 to move rack 131 and with it plate 107 and cam 103 vertically and thereby cause desired horizontal movement of cam follower 119, follower bar 121, operating bars 129 and corresponding rotational movement of operating shafts 10*b* and 11*b*. For securing operating handle 145 in door-locked position, a latch member comprising a pair of ears 147 mounted on a common shaft 149 and spaced apart the width of handle 145 is journaled on a bracket 151 projecting from cover plate web 101 in vertical alignment with pinion shaft 135 but spaced therebelow so that when swung outwardly to a substantially horizontal position limited by stop surface 153 on ears 147, the latter will embrace handle 145 and the projecting portions of ears 145 being formed with aligned holes 155 to receive the usual shipper's seal (not shown). To permit rotation of handle 145 from the door-closed position, latch ears 147 may be swung inwardly clear of the handle.

Operating plate 107 may also incorporate a bottom lock, consisting of a downwardly projecting locking bar 157 engageable with a keeper 159 on the car side below the door opening. If this is provided, the vertical upper dwell portion of cam slot 115 is made sufficiently long to prevent any lateral movement of the door while locking bar 157 is projected.

This embodiment of the invention provides an extremely flat operating mechanism particularly well adapted to refrigerator cars and other cars having insulated doors because as a result of its flatness the maximum insulation thickness consistent with lateral clearance limits can be provided. This embodiment also minimizes weight by utilizing a simple plate as a vertical movement operating member and utilizing the flanges of the cover plate as vertical guides therefor. With the positive guidance provided by sliding blocks 109, a single rack and pinion may be used advantageously with consequent reduction in complexity and weight.

The details of the door operating mechanism disclosed herein may be varied substantially without departing from the spirit of the invention and the exclusive use of such modifications as come within the scope of the appended claims is contemplated.

I claim:

1. In a plug door structure for a railway house car side wall opening, upright door operating shafts journaled on the door each having a crank arm at its lower end for supporting the door on a carriage movable along the wall, a shaft-rotating crank on each shaft spaced from its support arm, structure mounted for vertical movement parallel to the door and including a non-circular generally vertically oriented cam at least in part inclined from the vertical, follower means for said cam, means restricting said follower means to horizontal movement parallel to the door, an operating bar for each shaft horizontally aligned with said follower means and having one end connected thereto with its other end pivotally connected to said shaft-rotating crank whereby upon vertical movement of said structure said follower means and said operating bars are moved horizontally generally parallel to the door, rotating said cranks and causing said shafts to rotate and shift the door transversely of the wall, and means for selectively imparting vertical movement to said vertically movable structure, said vertical movement imparting means comprising rack means mounted on said vertically movable structure, pinion means journaled on the door and meshing with said rack means, and means for rotating said pinion means.

2. In a plug door structure according to claim 1, locking bars slidable on the door to project into keepers on the car wall at the sides of the door, and actuating means connected individually to said locking bars for retracting and projecting said locking bars, said vertically movable structure having surface portions engageable with said actuating means to retract and project said locking bars responsive to vertical movements of said vertically movable structure.

3. In a plug door structure according to claim 2, said cam means including a vertical dwell portion and an inclined portion, said surface portions of said vertically movable structure being related to the vertical dwell and inclined portions of said cam means whereby the initial vertical movement of said vertically movable structure when the door is closed and locked will first withdraw the locking bars inwardly of the door edges while the door operating shafts are stationary, and then rotate the door operating shafts to shift the door transversely of the car wall.

4. In a plug door structure according to claim 3, said cam means comprising a slot and said follower means comprising a member guidably received within said slot.

5. In a plug door structure for a railway house car side wall opening, upright door operating shafts journaled on the door each having a crank arm at its lower end for supporting the door on a carriage movable along the wall, a shaft-rotating crank on each shaft spaced from its support arm, structure mounted for vertical movement parallel to the door and including a cam at least in part inclined from the vertical, follower means for said cam, means restricting said follower means to horizontal movement with respect to the door, an operating bar for each shaft having one end pivotally connected to the shaft-rotating crank and being connected at its other end to said follower means whereby upon vertical movement of said structure said shafts are caused to rotate and shift the door transversely of the wall, and means for selectively imparting vertical movement to said vertically movable structure, locking bars slidable on the door to project into keepers on the car wall at the sides of the door, and actuating means connected individually to said locking bars for retracting and projecting said locking bars, said vertically movable structure having surface portions engageable with said actuating means to retract and project said locking bars responsive to vertical movements of said vertically movable structure, said cam means including a vertical dwell portion and an inclined portion, said surface portions of said vertically movable structure being related to the vertical dwell and inclined portions of said cam means whereby the initial vertical movement of said vertically movable structure when the door is closed and locked will first withdraw the locking bars inwardly of the door edges while the door operating shafts are stationary, and then rotate the door operating shafts to shift the door transversely of the car wall, said cam means comprising a slot and said follower means comprising a member guidably received within said slot, each said actuating means comprising a bellcrank journaled on the door, one arm of said bellcrank being connected to a locking bar, said vertically movable structure surface portions engageable with said actuating means comprising a vertical edge of said vertically movable structure and a recess in said edge, the other arm of said bellcrank being receivable in said recess when the door is closed and locked and the locking bars projected, and being engageable by a horizontal shoulder defining said recess when said vertically movable structure is moved vertically from its door-closed position whereby to engage the vertical edge of said vertically movable structure and retract the locking bar and hold it retracted during vertical displacement of said vertically movable structure from its door-closed position.

6. In a plug door structure according to claim 5, said vertical dwell portion of said cam means being positioned for engagement with said follower means while said other bellcrank arm is received in said recess, said inclined portion of said cam means being positioned for engagement with said follower while said other bellcrank arm is in engagement with the vertical edge of said vertically movable structure.

7. In a plug door structure according to claim 6, additional locking bars spaced vertically from said first-named locking bars, additional cranks fulcrumed on the door and individually connected to said additional locking bars, and vertical links pivotally connected at their opposite ends to said bellcranks and said additional cranks for causing them to operate in unison and retract all said locking bars simultaneously.

8. In a plug door structure according to claim 6, said vertically movable structure recess having a second shoulder spaced from and opposite said first-named shoulder and engageable with the other arm of said bellcrank to rotate the same in the opposite direction to its original rotation when the door is moved to fully-closed position and said cam follower means is in said vertical dwell portion of said cam means.

9. In a plug door according to claim 3, in which the door has a gasket on its inner face compressible when the door is in closed position, said inclined portion of said cam having a gradually inclined intermediate portion adjacent said vertical dwell portion to cause relatively slow transverse shifting of the door during decompression and compression of the door gasket and an opposite end portion more steeply inclined from the vertical to cause rapid transverse outward shifting of the door after decompression of the gasket and correspondingly rapid inward shifting of the door prior to compression of the gasket.

10. In a plug door structure according to claim 1, said cam means comprising a pair of cams inclined in opposite directions, said follower means comprising a pair of followers each engaging a separate cam and each being connected to a separate operating bar whereby to rotate said operating shafts in opposite directions responsive to vertical movements of said vertically movable structure.

11. In a plug door structure according to claim 9, said cam means comprising a pair of oppositely inclined but otherwise substantially identical cams, said follower means comprising a pair of followers each engaging a separate cam and each being connected to a separate operating bar whereby to rotate said operating shafts in opposite directions responsive to vertical movements of said vertically movable structure.

12. In a plug door structure according to claim 1, said rack means comprising a pair of vertical racks spaced apart from each other and said pinion means comprises a pair of pinions positioned in side by side relation between said racks and meshing with each other and each meshing with a different one of said racks, said rotating means comprising a handle fixed to one of said pinions.

13. In a plug door structure according to claim 1, an upright base plate parallel to the door surface, a cover plate having a web parallel to said base plate and spaced outwardly therefrom and having inwardly bent flanges along its upright sides, said vertically movable structure being positioned in the space defined by said cover plate and said base plate.

14. In a plug door structure according to claim 13, said vertically movable structure comprising a flat plate having bearing means on its sides slidably engaging adjacent surface portions of said base plate, said cover plate flanges and said cover plate web.

15. In a plug door structure according to claim 14, said vertical movement imparting means comprising a single upright rack mounted on said flat plate inwardly of said cover plate, a pinion engaging said rack and having its shaft journaled in said base plate and said cover plate web and projecting outwardly from the latter, and an operating handle affixed to said pinion shaft outwardly of said cover plate.

16. In a plug door structure according to claim 1, a locking bar projecting downwardly from said vertically movable structure and adapted to project into a keeper on the car side below the door when the vertically movable structure is in the door-closed position and for retraction therefrom by vertical movement of said vertically movable structure.

17. In a plug door structure according to claim 16, said cam means including a vertical dwell portion and an inclined portion, said downwardly projecting locking bar being related to the vertical dwell and inclined portions of said cam means whereby the initial vertical movement of said vertically movable structure will first retract said locking bar upwardly of the bottom edge of the door while the door operating shafts are stationary, and then rotate the door operating shafts to shift the door transversely of the car wall.

18. Operating mechanism for a railway house car side wall plug door comprising an upright base plate adapted for securement against the door, an upright cover plate having a web parallel to said base plate and inwardly directed flanges at each side, vertically movable and horizontally fixed structure positioned within the space defined by said base plate and said cover plate and including a non-circular generally vertically oriented cam at least in part inclined from the vertical, follower means for said cam positioned within the space so defined, said cover plate having a horizontal slot and said follower means having a portion projecting outwardly through said slot, a pair of operating bars in horizontal alignment with said follower means and extending horizontally parallel to the door in opposite directions and connected to said follower means projecting portion, said operating bars being adapted for connection to operating cranks on the door operating shafts, and means for selectively imparting vertical movement to said vertically movable structure, said vertical movement imparting means comprising rack means mounted on said vertically movable structure, pinion means journaled on the door and meshing with said rack means, and means for rotating said pinion means.

19. Plug door operating mechanism according to claim 18 wherein said vertically movable structure comprises a flat plate having bearing means on its sides slidably engaging adjacent surfaces of said base plate, said cover plate flanges and said cover plate web.

20. Plug door operating mechanism according to claim 19 wherein said vertical movement imparting means comprises a single upright rack fixed to said flat plate inwardly of said cover plate, a pinion engaging said rack and having its shaft journaled in said base plate and said cover plate web and projecting outwardly from the latter and an operating handle affixed to said pinion shaft outwardly of said cover plate.

21. Plug door operating mechanism according to claim 18 wherein a locking bar projects downwardly from said vertically movable structure and is adapted to project into a keeper on the car side below the door when the vertically movable structure is in the door-closed position and for retraction therefrom by vertical movement of said vertically movable structure.

22. Plug door operating mechanism according to claim 21 wherein said cam means includes a vertical dwell portion and an inclined portion, said downwardly projecting locking bar being related to the vertical dwell and inclined portions of said cam means whereby the initial vertical movement of said vertically movable structure will first retract said locking bar upwardly of the bottom edge of the door while the door operating shafts are stationary, and then rotate the door operating shafts to shift the door transversely of the car wall.

23. Plug door operating mechanism according to claim 18 wherein actuating means for horizontal locking bars slidable on the door to project into keepers on the car wall at the sides of the door are mounted on said base plate adjacent the sides of said vertically movable structure, said vertically movable structure having surface portions engageable with said actuating means to retract and project said locking bars responsive to vertical movements of said vertically movable structure.

* * * * *